US009266332B2

(12) United States Patent
Shimizu

(10) Patent No.: US 9,266,332 B2
(45) Date of Patent: Feb. 23, 2016

(54) LIQUID EJECTING APPARATUS

(71) Applicant: SEIKO EPSON CORPORATION, Tokyo (JP)

(72) Inventor: Kazutoshi Shimizu, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/484,687

(22) Filed: Sep. 12, 2014

(65) Prior Publication Data

US 2015/0085012 A1 Mar. 26, 2015

(30) Foreign Application Priority Data

Sep. 20, 2013 (JP) ..... 2013-195086

(51) Int. Cl.
*B41J 2/165* (2006.01)

(52) U.S. Cl.
CPC ..... *B41J 2/16508* (2013.01); *B41J 2/16523* (2013.01); *B41J 2/16538* (2013.01); *B41J 2/16588* (2013.01)

(58) Field of Classification Search
None
See application file for complete search history.

(56) References Cited

U.S. PATENT DOCUMENTS

2010/0079539 A1* 4/2010 Inoue ..... B41J 2/16535 347/33
2010/0245466 A1* 9/2010 Inoue ..... B41J 2/16535 347/30
2011/0234696 A1 9/2011 Inoue
2012/0026244 A1* 2/2012 Inoue ..... B41J 2/16585 347/33
2012/0038707 A1* 2/2012 Maida ..... B41J 2/16541 347/33
2012/0050403 A1 3/2012 Inoue
2012/0194610 A1* 8/2012 Kyoso ..... B41J 2/16552 347/33
2012/0249673 A1* 10/2012 Mita ..... B41J 2/16588 347/33
2013/0076830 A1* 3/2013 Inoue ..... B41J 2/16535 347/33

FOREIGN PATENT DOCUMENTS

JP 2009-233896 A 10/2009
JP 2011-206976 A 10/2011
JP 2012-051184 A 3/2012

* cited by examiner

*Primary Examiner* — Justin Seo
(74) *Attorney, Agent, or Firm* — Global IP Counselors, LLP

(57) ABSTRACT

A liquid ejecting apparatus with a reduced size is provided. There is provided a plurality of heads arranged in an arc shape, and configured to eject liquid, a plurality of maintenance units arranged in an arc shape, and configured to carry out maintenance on the heads, and a receiving section configured to receive liquid that drips from the maintenance units below the maintenance units in a vertical direction, and configured to flow the liquid in at least two directions.

6 Claims, 10 Drawing Sheets

LIQUID EJECTING APPARATUS

CROSS-REFERENCE TO RELATED APPLICATIONS

This application claims priority to Japanese Patent Application No. 2013-195086 filed on Sep. 20, 2013. The entire disclosure of Japanese Patent Application No. 2013-195086 is hereby incorporated herein by reference.

BACKGROUND

1. Technical Field

The present invention relates to a liquid ejecting apparatus.

2. Related Art

In the prior art, an image recording apparatus is known which is provided with a head which ejects ink droplets, a cleaning unit which cleans a droplet discharge surface of the head and the like. The cleaning unit is provided with an ejecting means which ejects cleaning liquid onto the droplet discharge surface, a wiping means which wipes the droplet discharge surface where the cleaning liquid is applied, and the like (see JP-A-2009-233896 (Patent Document 1), for example).

SUMMARY

In the image forming apparatus described above, installing an absorption body or the like is necessary for recovering waste liquid which is discharged from a maintenance unit during cleaning of the head. In a case where there are a plurality of heads, a plurality of maintenance units are also necessary and an absorption body is also necessary for each of the maintenance units. Absorption bodies are typically expensive and it is desirable to reduce use of the absorption bodies.

The present invention is for solving at least a portion of the problems described above and it is possible to realize the present invention with the embodiments and the applied examples below.

APPLIED EXAMPLE 1

A liquid ejecting apparatus according to the present applied example has a plurality of heads arranged in an arc shape, and configured to eject liquid, a plurality of maintenance units arranged in an arc shape, and configured to carry out maintenance on the heads, and a receiving section configured to receive liquid that drips from the maintenance units below the maintenance units in a vertical direction, and configured to flow the liquid in at least two directions.

According to this configuration, the receiving section is arranged below the maintenance unit. The liquid flows in a least two directions due to the receiving section. Due to this, for example, it is possible for the liquid dripping from the plurality of maintenance units which are arranged in an arc shape to efficiently flow and be recovered due to inclination of the receiving section. In addition, it is possible for the receiving section to be close with regard to any of the maintenance units using this shape since the liquid flows in at least two directions due to the receiving section. Due to this, recovery is possible without using a liquid absorption body.

APPLIED EXAMPLE 2

The liquid ejecting apparatus according to the applied example described above wherein, when viewed from a direction in which the maintenance units are seen in the arc shape, the receiving section has at least two inclinations. One of the inclinations slopes in a direction from a maintenance unit that is at the highest position out of the maintenance units toward a maintenance unit that is at the lowest position on a left side of a center of the arc shape. The other of the inclinations slopes in a direction from the maintenance unit that is at the highest position out of the maintenance units toward a maintenance unit that is at the lowest position on a right side of the center of the arc shape.

According to this configuration, directions of inclinations formed by the maintenance units arranged in the arc shape, and directions of the at least two inclinations are the same. Due to this, it is possible to shorten the distance between the maintenance units and the receiving section, and it is possible to reduce splatter of ink which drips from the maintenance unit. Here, the directions of the inclinations in this configuration are shown to be the same when the inclinations are largely divided into two, but the angles of inclinations are not necessarily limited to being the same.

APPLIED EXAMPLE 3

The receiving section of the liquid ejecting apparatus according to the applied example described above has a plurality of members that are arranged along an arc shape.

According to this configuration, since the receiving section is arranged along the arc shape, the distance between each of the maintenance units arranged along the arc shape, and the receiving section is shortened. Due to this, it is possible to suppress splatter of the liquid which is received from the maintenance units. In addition, the receiving section is configured by the plurality of members. As a result, for example, it is possible to easily manufacture the receiving section compared to a case where the receiving section is configured by one member.

APPLIED EXAMPLE 4

Portions of the plurality of members of the liquid ejecting apparatus according to the applied example described above overlap when viewed from above in the vertical direction.

According to this configuration, it is possible to prevent leaking of the liquid that is received from the maintenance units between the members.

APPLIED EXAMPLE 5

The plurality of members of the liquid ejecting apparatus according to the applied example described above have the same shape.

According to this configuration, it is possible to suppress manufacturing costs by using members with the same shape.

APPLIED EXAMPLE 6

The receiving section of the liquid ejecting apparatus according to the applied example described above has a single member with an arc shape.

According to this configuration, since the receiving section is arranged along the arc shape, the distance between the receiving section and each of the maintenance units is shortened. Due to this, it is possible to suppress splatter of the liquid which is received from the maintenance units.

BRIEF DESCRIPTION OF THE DRAWINGS

Referring now to the attached drawings which form a part of this original diclosure.

DETAILED DESCRIPTION OF EMBODIMENTS

A selected embodiment of the present invention will be described with reference to the drawings below. Here, in each of the following drawings, each of the members and the like is shown differently to the actual scale in order for the sizes of each of the members and the like to be recognizable.

First, a configuration of a liquid ejecting apparatus will be described. The liquid ejecting apparatus records (forms) an image on a recording medium by applying ink with regard to the recording medium and has a plurality of heads which are arranged in an arc shape and eject liquid, a plurality of maintenance units which carry out maintenance on the heads and are arranged in an arc shape, a receiving section which receives a liquid which drips from the maintenance units in the vertical direction of the maintenance units with the liquid flowing in at least two directions, a waste liquid recovery section which recovers ink which drips, and the like. Then, a control section which controls driving of each of the members and the like in the liquid ejecting apparatus is provided. Below, the liquid ejecting apparatus will be described in detail.

Figure 1:
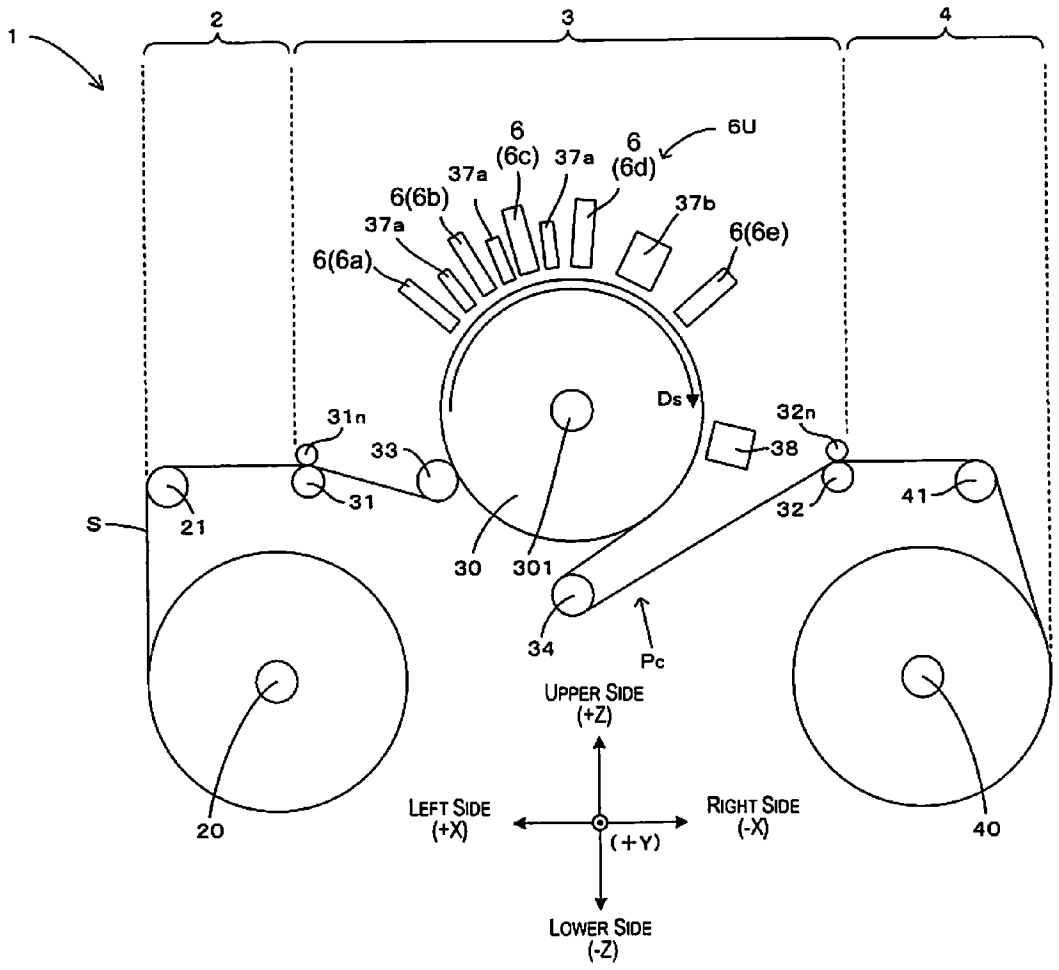
FIG. 1 is a configuration diagram illustrating a configuration of a liquid ejecting apparatus.
Figure 2:
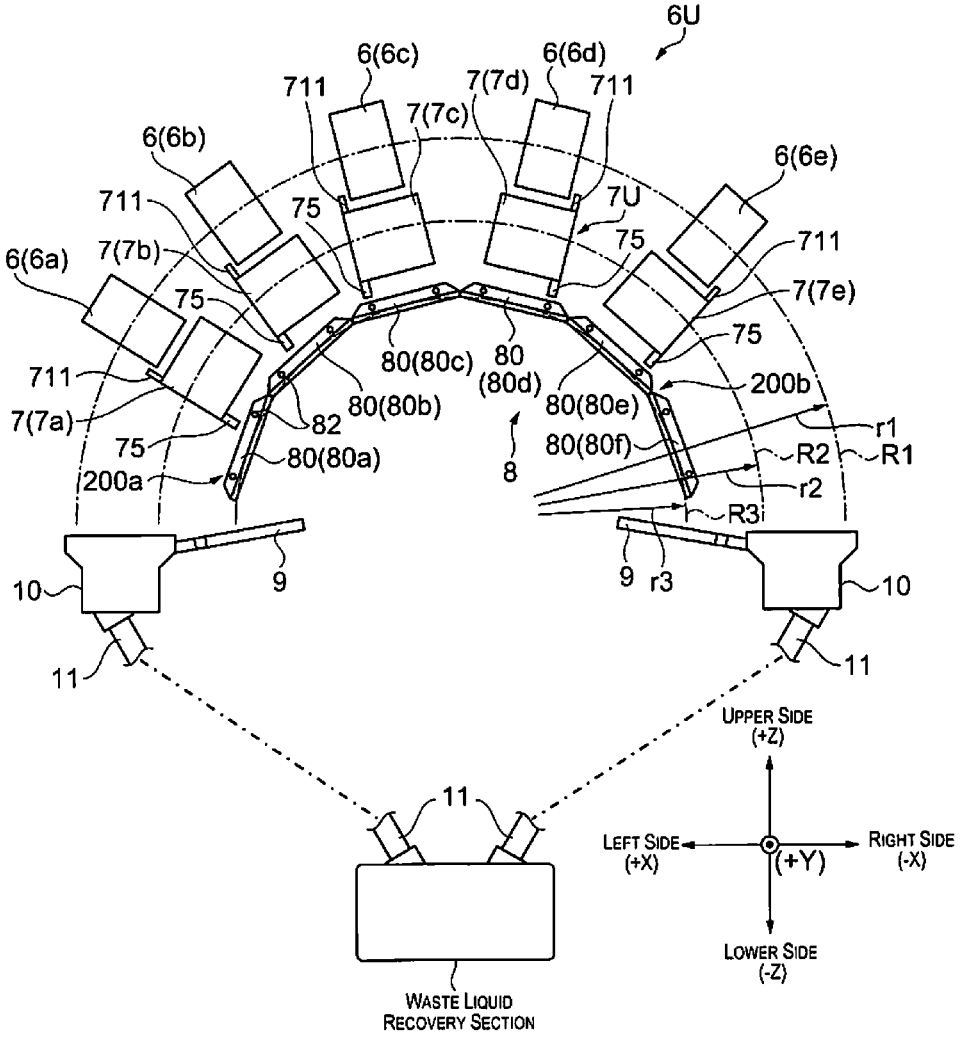
FIG. 2 is a configuration diagram illustrating a portion of a configuration of the liquid ejecting apparatus.

FIG. 1 is a configuration diagram illustrating a configuration of the liquid ejecting apparatus. In addition, FIG. 2 is a configuration diagram illustrating a portion of a configuration of the liquid ejecting apparatus. Here, a three dimensional coordinates system, which correspond to a left and right direction X, a front and back direction Y, and a vertical direction Z of a liquid ejecting apparatus 1, is shown in the following diagrams in order to clarify the arrangement relationships of each section of the liquid ejecting apparatus 1 as necessary.

As shown in FIG. 1, a feeding section 2, a processing section 3, and a winding section 4 are arranged to line up in the liquid ejecting apparatus 1 in the left and right direction. The feeding section 2 and the winding section 4 respectively have a feeding shaft 20 and a winding shaft 40. Then, both ends of a sheet S (a wafer) are wound around into the shape of a roll by the feeding section 2 and the winding section 4 and are stretched between the feeding section 2 and the winding section 4. After the sheet S is transported from the feeding shaft 20 to the processing section 3 along a transport path Pc which stretches out in this manner and undergoes an image recording process using a printing unit 6U, the sheet S is transported to the winding shaft 40. It is possible for the classification of the sheets S to be divided into paper and film. To give specific examples, paper is high-quality paper, cast paper, art paper, coated paper, and the like and film is resin paper, PET (polyethylene terephthalate), PP (polypropylene), and the like. Here, in the following description, out of both surfaces of the sheet S, the surface on which an image is recorded is the front surface and the surface on the opposite side is the rear surface.

The feeding section 2 has the feeding shaft 20 around which an edge of the sheet S is wound and a driven roller 21 onto which the sheet S which is drawn out from the feeding shaft 20 is wound. The feeding shaft 20 supports the end of the sheet S by being wound around in a state where the front surface of the sheet S faces towards the outside. Then, the sheet S which is wound around the feeding shaft 20 is fed out to the processing section 3 through the driven roller 21 by the feeding shaft 20 being rotated in a clockwise direction in FIG. 1.

The processing section 3 records an image on the sheet S using the printing unit 6U while supporting the sheet S, which is fed out from the feeding section 2, on a platen drum 30. The printing unit 6U is provided with a plurality of heads 6. In the present embodiment, five of the heads 6 (6*a* to 6*e*) are provided. The plurality of heads 6 (6*a* to 6*e*) are arranged in an arc shape. In more detail, the plurality of heads 6 (6*a* to 6*e*) are arranged to be inclined along a circumference surface of the platen drum 30. Here, arranged in an arc shape has the meaning of a portion of the plurality of heads 6 (6*a* to 6*e*) in the arrangement being arranged at positions where it is possible to draw a virtual line which is an arc which passes through the heads. In addition, arc also includes an arc which is an ellipse. Here, the heads 6 (6*a* to 6*e*) of the present embodiment are arranged on a virtual line R1 which is an arc. Here, the virtual line R1 which is an arc is a line which is drawn with a radius r1.

Then, an image is recorded on the sheet S by the plurality of heads 6 (6*a* to 6*e*) which are arranged in an arc shape discharging ink with regard to the sheet S which is supported on the front surface of the platen drum 30. A front drive roller 31 and a rear drive roller 32 are provided in the processing section 3, on both sides of the platen drum 30 and the sheet S which is transported from the front drive roller 31 to the rear drive roller 32 is supported by the platen drum 30 and an image is formed on the sheet S which is supported.

The front drive roller 31 has a plurality of micro protrusions, which are formed by thermal spraying, on the outer circumference surface, and the sheet S, which is fed out from the feeding section 2, is wound onto the front drive roller 31 from the rear surface side. Then, the sheet S which is fed out from the feeding section 2 is transported to the platen drum 30 through a driven roller 33 by the front drive roller 31 being rotated in a clockwise direction in FIG. 1. Here, a nip roller 31*n* is provided with regard to the front drive roller 31. The nip roller 31*n* impacts against the front surface of the sheet S in a state of being pressed to the front drive roller 31 side and the sheet S is pinched between the nip roller 31*n* and the front drive roller 31. Due to this, frictional force is maintained between the front drive roller 31 and the sheet S, and it is possible to reliably perform transporting of the sheet S using the front drive roller 31.

The platen drum 30 is a drum with a cylindrical shape which supports in a freely rotating manner using a support mechanism which is omitted from the diagrams, and the sheet S, which is transported from the front drive roller 31 to the rear drive roller 32, is wound onto the platen drum 30 from the rear surface side. The platen drum 30 is driven and rotates in the transport direction Ds of the sheet S by receiving the frictional force between the platen drum 30 and the sheet S, and the platen drum 30 supports the sheet S from the rear surface side. In addition, driven rollers 33 and 34, which fold back the sheet S at both sides of a section for winding onto the platen drum 30, are provided in the processing section 3. Among these, the driven roller 33 folds back the sheet S by the front surface of the sheet S being wound onto between the front drive roller 31 and the platen drum 30. On the other hand, the driven roller 34 folds back the sheet S by the front surface of the sheet S being wound onto between the platen drum 30 and the rear drive roller 32. In this manner, it is possible to ensure that the section for winding onto the platen drum 30 be long by the sheet S being folded back on each of the upstream side and the downstream side in the transport direction Ds with regard to the platen drum 30.

The rear drive roller 32 has a plurality of micro protrusions, which are formed by thermal spraying, on the outer circumference surface, and the sheet S, which is transported from the platen drum 30 via the driven roller 34, is wound onto the rear drive roller 32 from the rear surface side. Then, the sheet S is transported to the winding section 4 by the rear drive roller 32 being rotated in a clockwise direction in FIG. 1. Here, a nip roller 32*n* is provided with regard to the rear drive roller 32. The nip roller 32*n* impacts against the front surface of the sheet S in a state of being pressed to the rear drive roller 32 side and the sheet S is pinched between the nip roller 32*n* and the rear drive roller 32. Due to this, frictional force is maintained between the rear drive roller 32 and the sheet S, and it is possible to reliably perform transporting of the sheet S using the rear drive roller 32.

In this manner, the sheet S which is transported from the front drive roller 31 to the rear drive roller 32 is supported on the outer circumference surface of the platen drum 30. Then, the plurality of heads 6*a* to 6*d* are provided in the processing section 3 to correspond to colors which are different to each other in order to record color images with regard to the front surface of the sheet S which is supported on the platen drum 30. In detail, four of the heads 6*a* to 6*d* which correspond to yellow, cyan, magenta, and black are arranged to line up along the transport direction Ds in this color order.

The heads 6 (6*a* to 6*d*) are installed with configurations which are the same as each other and face the front surface of the sheet S which is supported by the platen drum 30 spaced with a slight clearance. Then, it is possible for ink of corresponding colors from nozzles, which are opened toward the front surface of the platen drum 30, to be discharged using an ink jet system. Due to this, a color image is formed on the front surface of the sheet S by ink being discharged with regard to the sheet S which is transported along the transport direction Ds.

Here, UV (ultraviolet) ink (photocurable ink) which is cured by irradiating ultraviolet rays (light) is used as the ink in the present embodiment. Therefore, UV lamps 37*a* and 37*b* are provided in order to fix the ink to the sheet S by curing the inks. Here, curing of ink is executed by being divided into two steps of provisional curing and complete curing. The UV lamps 37*a* for provisional curing are arranged between each of the heads 6*a* to 6*d*. That is, the UV lamps 37*a* cure (provisionally cure) the ink by irradiating ultraviolet rays with a relatively low irradiation intensity to an extent where the shape of the ink does not collapse, and the ink is not completely cured. On the other hand, the UV lamp 37*b* for complete curing is provided on the downstream side in the transport direction Ds with regard to the heads 6*a* to 6*d*. That is, the UV lamp 37*b* cures (completely cures) the ink by irradiating ultraviolet rays which are stronger than the UV lamps 37*a*. In this manner, it is possible to fix the color image, which is formed by the heads 6*a* to 6*d*, to the front surface of the sheet S by executing provisional curing and complete curing.

Furthermore, the head 6*e* is arranged on the downstream side in the transport direction Ds with regard to the UV lamp 37*b* to face the front surface of the platen drum 30. The head 6*e* is installed with a configuration which is the same as the heads 6*a* to 6*d* and discharges transparent UV ink onto the front surface of the sheet S using an ink jet system. That is, the head 6*e* is opposed with regard to the front surface of the sheet S which is supported by the platen drum 30 spaced with a slight clearance. Due to this, transparent ink is further discharged with regard to the color image which is formed in four colors by the heads 6*a* to 6*d*.

Furthermore, a UV lamp 38 is provided on the downstream side in the transport direction Ds with regard to the head 6*e*. The UV lamp 38 completely cures (complete curing) the transparent ink which is discharged by the printing head 6*e* by irradiating strong ultraviolet rays. Due to this, it is possible to fix the transparent ink to the front surface of the sheet S.

In this manner, the processing section 3 appropriately performs discharging and curing of the ink with regard to the sheet S which is supported on the platen drum 30 and forms a color image which is coated with the transparent ink. Then, the sheet S which is formed as a color image is transported by the rear drive roller 32 to the winding section 4.

The winding section 4 has the winding shaft 40 around which the end of the sheet S is wound, and a driven roller 41 onto which the sheet S, which is transported to the winding shaft 40, is wound. The winding shaft 40 supports the end of the sheet S by being wound around in a state where the front surface of the sheet S faces towards the outside. Then, the sheet S is wound around the winding shaft 40 through the driven roller 41 by the winding shaft 40 being rotated in a clockwise direction in FIG. 1.

As shown in FIG. 2, the liquid ejecting apparatus 1 is provided with a maintenance unit group 7U which executes maintenance with regard to the heads 6 (6*a* to 6*e*). The maintenance unit group 7U is provided with a plurality of maintenance units 7. Five of the maintenance units 7 (7*a* to 7*e*) are provided in the present embodiment. Then, the maintenance units 7*a* to 7*c* are arranged one by one with regard to each of the heads 6*a* to 6*e*. Then, the plurality of maintenance units 7 (7*a* to 7*e*) are arranged in an arc shape. Here, arranged in an arc shape has the meaning of a portion of the maintenance units 7 (7*a* to 7*e*) in the arrangement being arranged at positions where it is possible to draw a virtual line which is an arc which passes through the maintenance units. In addition, arc also includes an arc which is an ellipse. Here, the maintenance units 7 (7*a* to 7*e*) of the present embodiment are arranged on a virtual line R2 which is an arc. Here, the virtual line R2 which is an arc is a line which is drawn with a radius r2.

The maintenance unit group 7U is provided adjacent to the platen drum 30 in the Y axis direction. Then, in a case where maintenance is performed on the heads 6 (6*a* to 6*e*), it is possible for the heads 6 (6*a* to 6*e*) to oppose the maintenance units 7 (7*a* to 7*e*) by moving the printing unit 6U in the Y axis direction using a moving apparatus which is not shown in the diagram.

Figure 3:
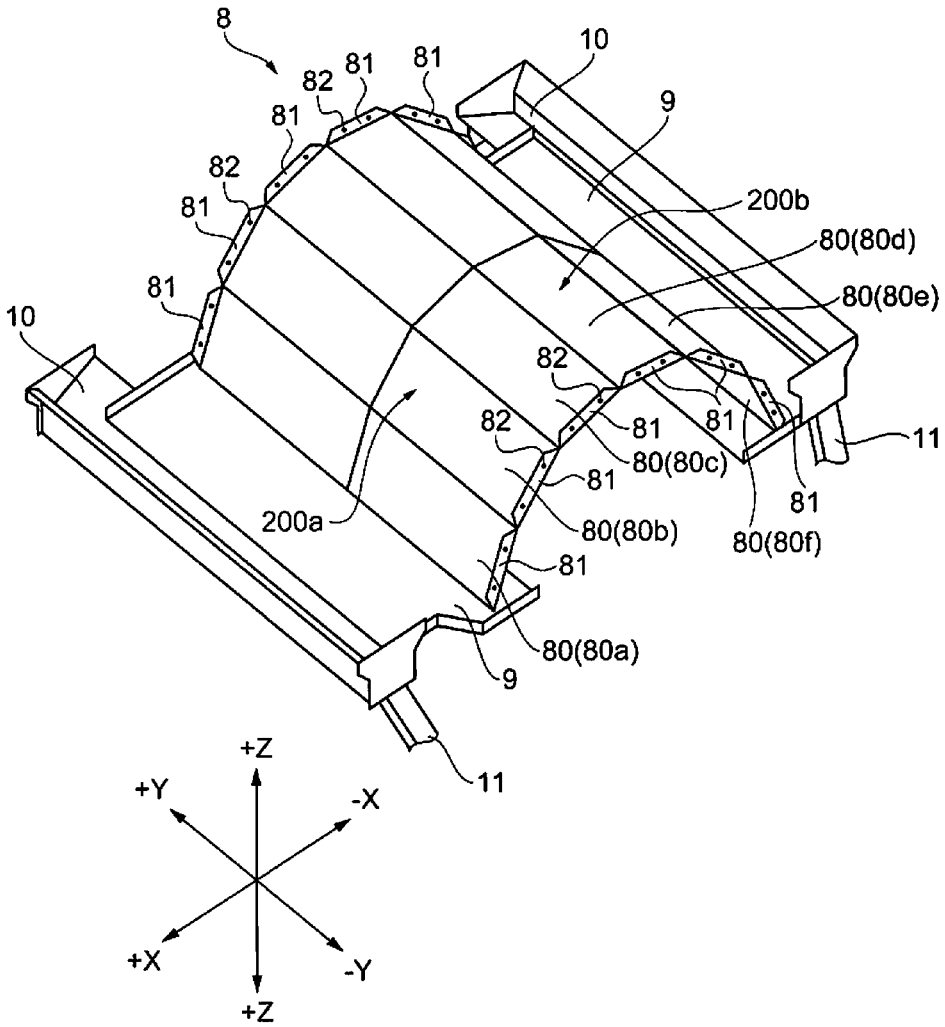
FIG. 3 is a perspective diagram illustrating a configuration of a receiving section.

Next, the configuration of the receiving section will be described. FIG. 3 is a perspective diagram illustrating a configuration of the receiving section. As shown in FIG. 2 and FIG. 3, a receiving section 8, which receives liquid which drips from the maintenance units 7 (7*a* to 7*e*) of the maintenance unit group 7U, is arranged at the lower side (below in the vertical direction) of the maintenance unit group 7U. For example, the receiving section 8 receives waste liquid which is liquid which is discharged from the maintenance units 7 (7*a* to 7*e*) and guides the liquid to a waste liquid recovery section. The receiving section 8 is provided with at least two inclinations. Two inclinations 200*a*, 200*b* are provided in the present embodiment.

The receiving section 8 is configured by a plurality of members 80. The receiving section 8 is configured by six members 80 (80*a* to 80*f*) in the present embodiment. In addition, the members 80 (80*a* to 80*f*) are formed in the same shape. The members 80 (80*a* to 80*f*) are formed in a shape which is substantially a plate in the present embodiment. Due to this configuration, it is possible to suppress manufacturing costs. Then, the plurality of members 80 (80*a* to 80*f*) are arranged in an arc shape. Here, arranged in an arc shape has the meaning of a portion of the plurality of members 80 (80*a* to 80*f*) in the arrangement being arranged at positions where it is possible to draw a virtual line which is an arc which passes through the members. In addition, arc also includes an arc which is an ellipse. Here, the members 80 (80*a* to 80*f*) of the present embodiment are arranged on a virtual line R3 which is an arc. Here, the virtual line R3 which is an arc is a line which is drawn with a radius r3. Here, as shown in FIG. 2, the dimensions of the radius r1 which represents the arc shape of the heads 6 (6*a* to 6*e*), the radius r2 which represents the arc shape of the maintenance units 7 (7*a* to 7*e*), and the radius r3 which represents the arc shape of the receiving sections 8 are different. In addition, the dimensions of the radius r3 which corresponds to the receiving sections 8 is shorter than the dimensions of the radius r2 which corresponds to the maintenance units 7. In addition, a portion of the receiving sections 8 are arranged inside the range of the arc shape which is formed by the maintenance units 7. As a result, it is possible to arrange each of the maintenance units 7*a* to 7*e* and the members 80*a* to 80*f* of the receiving section 8 to be close to each other. Due to this, it is possible to suppress splatter of the liquid (waste liquid) which is discharged (drips) from discharge tubes 75 of the maintenance units 7*a* to 7*e*. Furthermore, it is possible to reduce the size of the apparatus configuration.

The inclination 200*a* of the present embodiment is configured by members 80*a*, 80*b* and 80*c*, and the inclination 200*b* is configured by members 80*d*, 80*e* and 80*f*. Then, the inclination 200*a* slopes in a direction (a direction which is from the upper right to the lower left) from the maintenance unit 7*c*, which is at the highest position out of the plurality of maintenance units 7 (7*a* to 7*e*), toward the maintenance unit 7*a* which is at the lowest position on the left side of the center of the arc shape, and the inclination 200*b* slopes in a direction from the maintenance unit 7*d*, which is at the highest position out of the plurality of maintenance units 7 (7*a* to 7*e*), toward the maintenance unit 7*e* which is at the lowest position on the right side of the arc shape. In other words, the two inclinations 200*a* and 200*b* are formed so as to be convex toward the highest position of the arc, which is formed by the maintenance units 7, in the vertical direction. Accordingly, in the present embodiment, the inclination 200*a* is configured so as to receive liquid which drips from the maintenance unit 7*c* and the maintenance units 7*a* and 7*b* which are arranged below the maintenance unit 7*c*, and the inclination 200*b* is configured so as to receive liquid which drips from the maintenance unit 7*d* and the maintenance unit 7*e* which is arranged below the maintenance unit 7*d*.

In addition, the plurality of members 80*a* to 80*f* overlap with the adjacent members 80*a* to 80*f* when viewed from above in the vertical direction. In detail, in each of the inclinations 200*a* and 200*b*, a portion of the members 80*c* and 80*d*, which are arranged to be relatively higher, are configured so as to overlap with and be above the members 80*b* and 80*e* which are arranged below. In addition, a portion of the members 80*b* and 80*e* are configured so as to overlap with and be above the members 80*a* and 80*f* which are arranged below. As a result, it is possible to effectively guide downward liquid which is received by each of the inclinations 200*a* and 200*b*. In addition, it is possible to prevent leaking of liquid between the members 80*a* to 80*f*.

In addition, both end sections which correspond to the Y axis direction of the members 80*a* to 80*f* have protrusion sections 81 which protrude in a direction where the maintenance unit group 7U is arranged. Due to the protrusion sections 81, it is possible to prevent leaking of liquid received from the maintenance units 7 from the Y axis direction. In addition, a through-hole 82 is provided in the protrusion section 81. The through-hole 82 is for fixing a fixing member which joins between the members 80*a* to 80*f* and which is not shown in the diagrams. Due to the fixing member, it is possible to maintain the arc shape of the receiving section 8 and reliably guide liquid.

In addition, a relay plate 9 is provided below the member 80*a* and the member 80*f*, and a gutter section 10 is provided below each relay plate. The relay plate 9 further receives liquid which is received by the receiving section 8 and guides the liquid to the gutter section 10. The relay plate 9 is inclined such that it is easy for liquid to flow from the members 80*a* and 80*f* to the gutter section 10 in a downward direction from the members 80*a* and 80*f* toward the gutter section 10. The liquid which collects in the gutter section 10 flows from a discharge section 11 and is recovered in the waste liquid recovery section. The gutter section 10 slopes toward the discharge section 11 side so that liquid flows effectively to the discharge section 11. It is preferable that the members 80*a* to 80*f*, the relay plate 9, and the gutter section 10 be a material which does not absorb liquid. It is possible for the liquid to flow without being absorbed if, for example, the material is metal or plastic. In addition, metal or plastic are less expensive than absorption bodies. Here, the gutter section 10 may be the waste liquid recovery section as long as there is capacity to recover as much liquid as possible in the gutter section 10.

Next, the configuration of the heads 6 (6*a* to 6*e*) and the maintenance units 7 (7*a* to 7*e*) will be described. Here, since the heads 6*a* to 6*e* and the maintenance units 7*a* to 7*e* are each equipped with the same configuration, the configuration of the head 6*c* and the maintenance unit 7*c* will be given below as examples.

Figure 4:
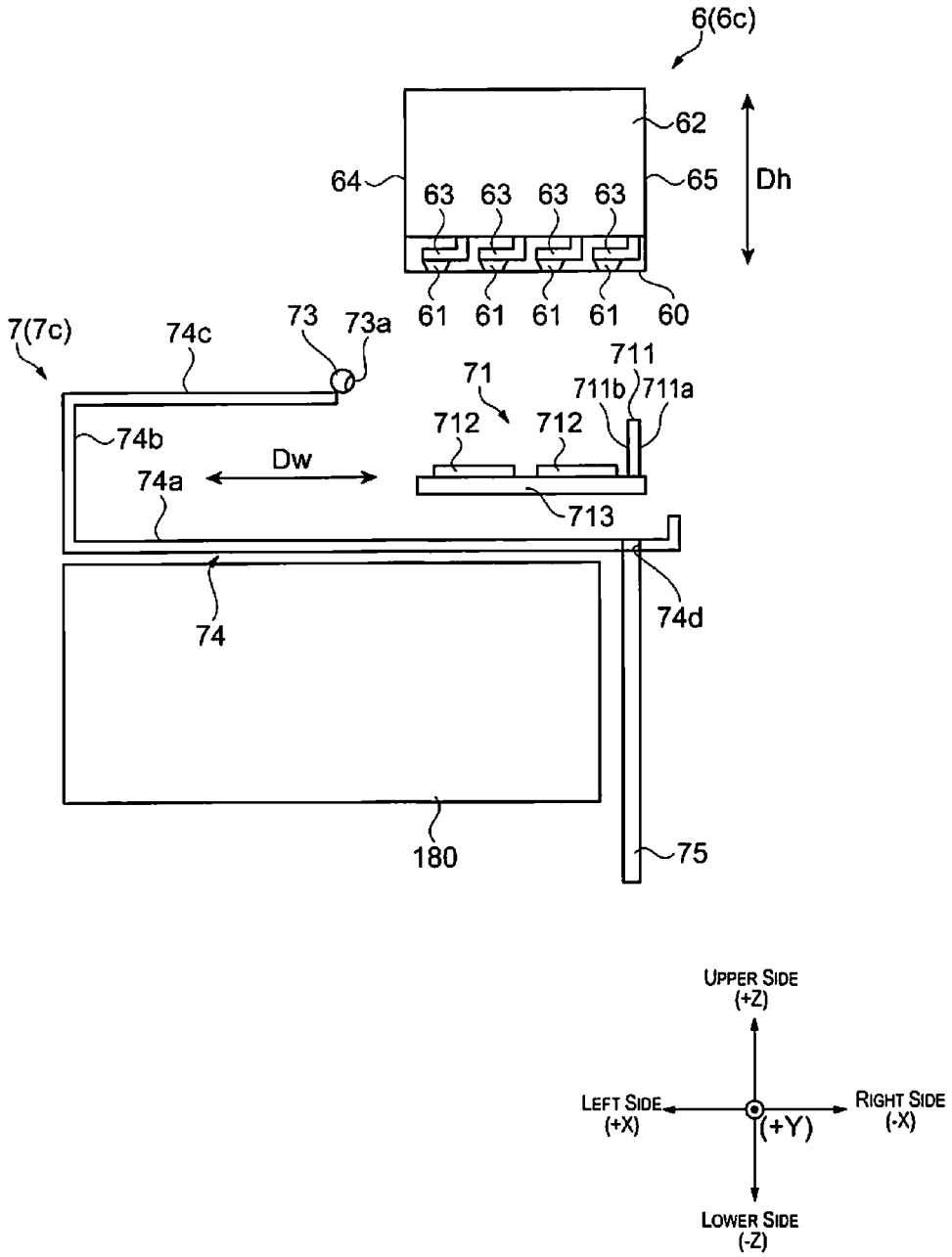
FIG. 4 is a schematic diagram illustrating a configuration of a head and a maintenance unit.

FIG. 4 is a schematic diagram illustrating a configuration of a head and a maintenance unit. Here, for ease of explanation below, the head 6 and the maintenance unit 7 will be described in a state of being arranged substantially horizontally.

The head 6 is configured to move freely in the Y axis direction between a printing position above the platen drum 30 and a maintenance position above the maintenance unit group 7U using a movement mechanism which is not shown in the diagram. Furthermore, the head 6 moves freely in a retreating direction Dh which is orthogonal to a nozzle forming surface 60 of the head 6 so as to be able to take a cleaning position which is close to the maintenance unit group 7U in the maintenance position or a retreating position which is separated from the maintenance unit group 7U in the maintenance position. Then, the head 6 is configured so as to appropriately move in the retreating direction Dh according to the maintenance process during maintenance and to execute maintenance such wiping or capping with regard to nozzle forming surface 60 of the head 6. In addition, the head 6 adjusts the speed, pressure, and the like of ink which is circulated between a tank which retains ink (which is not shown in the diagrams) and a reservoir 62 of the head 6 using an ink circulation mechanism which is not shown in the diagrams.

The head 6 has a nozzle 61 which is an opening in the nozzle forming surface 60, the reservoir 62 which temporarily retains ink, and a cavity 63 which communicates between the nozzle 61 and the reservoir 62, and ink is supplied from the reservoir 62 to the nozzle 61 via the cavity 63. Then, ink is discharged from the nozzle 61 by the cavity 63 applying pressure to the ink.

The maintenance unit 7 is configured by being provided with, a moving body 71 which has a wiper 711, a cap 712, and a support member 713 which supports the wiper 711 and the cap 712 so as to be able to move integrally, a drive mechanism 180 which moves the moving body 71 which extends along the nozzle forming surface 60 in a wiping direction Dw, a cleaning liquid supply tube 73 which ejects cleaning liquid from an ejection opening 73*a*, a casing 74, and the like. Each of these members has a length in the Y axis direction substantially equal to or more than the head 6, and it is possible to perform maintenance with regard to the entire region of the nozzle forming surface 60. Then, wiping, where ink which adheres to the nozzle forming surface 60 is wiped away, is performed by the wiper 711 moving in the wiping direction Dw in a state where wiping surfaces 711*a* and 711*b* impact with the nozzle forming surface 60. In addition, capping, where the cap 712 is closely abutted to the head 6, is performed so that the cap 712 surrounds the nozzle 61.

The cleaning liquid supply tube 73 has a plurality of ejection openings 73*a*, which are openings toward the head 6 side, in the Y axis direction, and it is possible for cleaning liquid to be ejected with regard to a target supply surface 64 which is a side surface of the head 6 on the cleaning liquid supply tube 73 side when the head 6 is at a cleaning position which is close to the maintenance unit 7. Here, although it is possible to appropriately use a liquid which is suitably used for cleaning as the cleaning liquid, in a case where UV ink is used such as in the present embodiment, it is preferable to use a solvent which is able to dissolve UV ink which has been cured. As such a solvent, for example, examples include EDGAC (ethyl di glycol acetate), transparent UV ink or the like. In addition, a solvent where a surfactant, polymerization inhibitor, or the like is added to these solvents may be used as the cleaning liquid.

The casing 74 is mainly configured by having a bottom surface section 74*a* which is substantially parallel in the wiping direction Dw, a side wall section 74*b* which is erected from an edge of the bottom surface section 74*a* in the wiping direction Dw, and a top section 74*c* which extends from an upper edge of the side wall section 74*b* on the same side as the bottom surface section 74*a* along the wiping direction Dw. The bottom surface section 74*a* is provided over a range which is slightly wider than the range where it is possible for the moving body 71 to move in the wiping direction Dw and receives waste liquid which includes ink, cleaning liquid or the like which is generated during maintenance. The waste liquid which is received by the bottom surface section 74*a* is discharged from the maintenance unit 7 from a discharge opening 74*d* which is formed in the bottom surface section 74*a* via the discharge tube 75. The dimensions of the top section 74*c* in the wiping direction Dw are larger than the moving body 71. Then, during a printing operation, the moving body 71 is maintained in a state where the moving body 71 is at a standby position which is below the top section 74*c* and is covered by the top section 74*c*. By doing this, the top section 74*c* blocks light (ultraviolet rays) which is irradiated from the UV lamps 37*a*, 37*b* and 38 and suppresses curing of UV ink which is adhered to the wiper 711 and the cap 712. Here, it is not necessary to include all of the maintenance units 7 in the configuration as long as at least one of the maintenance units 7 is included.

Next, a method for operating the liquid ejecting apparatus will be described. In detail, the method for operating the liquid ejecting apparatus in a case where maintenance is carried out on the head 6*c* using the maintenance unit 7*c* will be described. FIGS. 5A to 5H, FIGS. 6A and 6B, and FIG. 7 are schematic diagrams illustrating a method for operating the liquid ejecting apparatus. In maintenance carried out by the maintenance unit 7*c*, cleaning liquid is ejected onto the target supply surface 64 which is a side surface of the head 6*c*, the wiper 711 is operated to move back and forth a plurality of times in the wiping direction Dw, and pressure cleaning is further performed. Here, the description below, an edge position on the target supply surface 64 side in the back and forth operation of the wiper 711 indicates a starting point P1, and an edge position on the opposite side (side surface 65 side) in the back and forth operation of the wiper 711 indicates a stopping point P2.

Figure 5A:
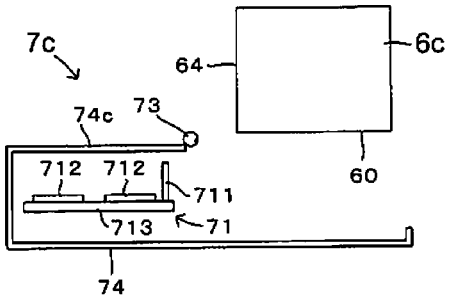
FIGS. 5A, 5B, 5C, 5D, 5E, 5F, 5G and 5H are schematic diagrams illustrating a method for operating the liquid ejecting apparatus.

First, as shown in FIG. 5A, maintenance is started in a state where the head 6*c* is at the retreating position which is separated from the maintenance unit 7*c* and where the wiper 711 is at the standby position which is below the top section 74*c*. When maintenance is started, first, the number N of back and forth operations of the wiper 711 is set to 0. Then, the drive mechanism 180 (refer to FIG. 4) moves the wiper 711 to the starting point P1 and moves the head 6*c* to the cleaning position which is close to the maintenance unit 7*c*. As a result, as shown in FIG. 5B, there is a state where a front edge section of the wiper 711 opposes the target supply surface 64 of the head 6*c*, in other words, a state where a portion of the wiper 711 and the target supply surface 64 overlap in the retreating direction Dh.

Next, cleaning liquid is ejected from the ejection opening 73*a* of the cleaning liquid supply tube 73 towards the target supply surface 64 of the head 6. The cleaning liquid which is ejected from the ejection opening 73*a* passes above the wiper 711 and lands on the target supply surface 64 without landing on the wiper 711. As shown in FIG. 5C, when cleaning liquid CL is ejected onto the target supply surface 64, the cleaning liquid CL which is adhered to the target supply section 64 flows down along the target supply section 64 and is retained at a corner section 66 between the target supply section 64 and the nozzle forming surface 60.

When sufficient cleaning liquid is supplied, ejecting of the cleaning liquid is stopped, and wiping is performed by the wiper 711 being moved from the starting point P1 to the stopping point P2. In this process, the wiping surface 711*a* of the wiper 711 impacts with the corner section 66, and cleaning liquid CL which is retained at the corner section 66 is held by the wiper 711 as shown in FIG. 5D. Then, wiping is performed as the cleaning liquid CL which is held by the wiper 711 is widely coated over the nozzle forming surface 60.

Figure 5E:
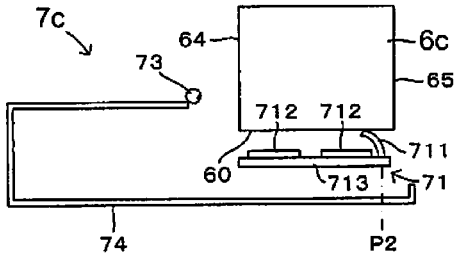
Figure 5B:
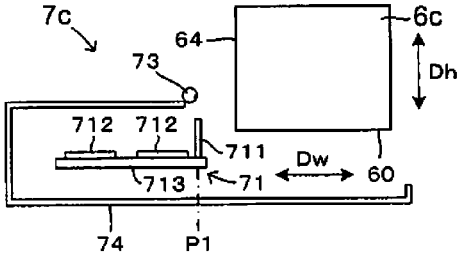

FIG. 5E illustrates a state where the wiper 711 is moved to the stopping point P2. The stopping point P2 of the back and forth operation of the wiper 711 is positioned below the head 6*c*. In this manner, the position of the stopping point P2 is set below the head 6*c* due to the following reasons. When the wiper 711 is moved further to the right of the side surface 65 which is the opposite side to the target supply surface 64, the wiping surface 711*b* of the wiper 711 impacts with the side surface 65 (refer to FIG. 4) when the wiper 711 subsequently moves toward the starting point P1. Since cleaning liquid is not ejected onto the side surface 65, there is a concern that there will be foreign matter such as UV ink which has been cured and that the foreign matter adheres to the wiper 711 when the wiper 711 impacts with the side surface 65. Therefore, impacting of the wiping surface 711*b* and the side surface 65 is avoided and realization of favorable wiping is achieved due to the position of the stopping point P2 being below the head 6*c*.

Figure 5F:
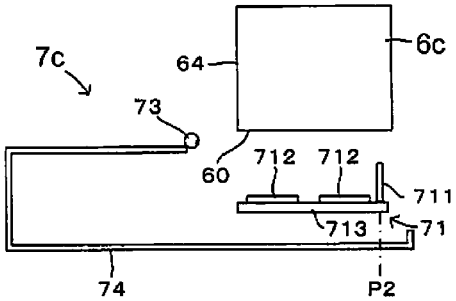
Figure 5C:
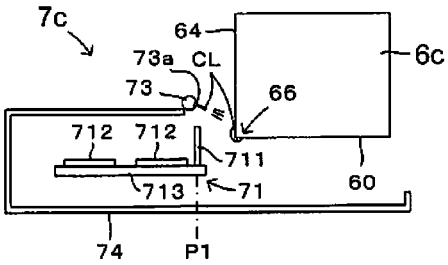
Figure 5G:
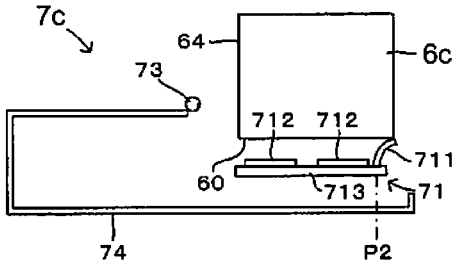
Figure 5D:
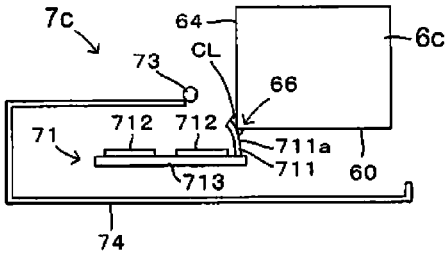
Figure 5H:
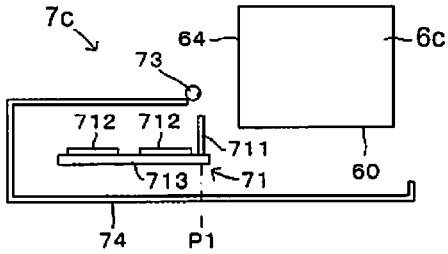

Next, the head 6*c* is temporarily moved to the retreating position and then returns again to the cleaning position. As shown in FIG. 5F, due to the head 6*c* being temporarily moved to the retreating position in this manner, a state where the wiper 711, which is positioned at the starting point P2, is bent to the left is alleviated. Then, as shown in FIG. 5G, movement of the wiper 711 from the stopping point P2 to the starting point P1 is performed smoothly if the wiper 711 is bent to the right by the nozzle forming surface 60 when the head 6*c* returns to the cleaning position. Here, for example, it is possible to for the wiper 711 to be reliably bent to the right when the head 6*c* returns to the cleaning position if the wiper 711 is attached so that the wiper 711 is slightly tilted to the right in the state in FIG. 5F.

Wiping is performed by moving the wiper 711 from the stopping point P2 to the starting point P1 in a state where the wiper 711 is bent to the right. In this manner, the back and forth operation of the wiper 711 stops once (FIG. 5H) when the wiper 711 returns to the starting point P1. Next, the head 6*c* is temporarily moved to the retreating position and is moved again to the cleaning position. Then, the back and forth operation of the wiper 711 is performed a specified number of times (FIG. 5B to FIG. 5H). Above, the maintenance unit 7*c* was described as an example, but the maintenance units 7*a* and 7*b* are also the same as described above. Here, the arrangement direction of the maintenance units 7*d* and 7*e* is the opposite direction to the maintenance unit 7*c*. This is because the inclination directions, in which the maintenance units 7*a*, 7*b* and 7*c* and the maintenance units 7*d* and 7*e* are arranged, are different. Then, pressure cleaning is executed after the back and forth operation of the wiper 711 has been completed a set number of times.

In pressure cleaning, first, the circulation speed of the ink due to the ink circulation mechanism is accelerated to a pressurization speed which is faster than a normal speed during a printing operation.

Figure 6A:
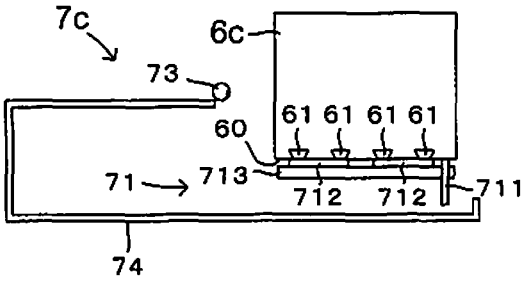
FIGS. 6A and B are schematic diagrams illustrating a method for operating the liquid ejecting apparatus.

Next, as shown in FIG. 6A, since the moving body 71 of the maintenance unit 7*c* is moved below the head 6*c*, all of the nozzles 61 are capped by the nozzle forming surface 60 being pressed against the cap 712 due to the head 6*c* being moved to a capping position which is further below the cleaning position. Here, the wiper 711 is normally maintained in a state of protruding upward from the support member 713 due to a pressing member which is not shown in the diagrams, but when the head 6*c* is moved to the capping position, the head 6*c* moves the wiper 711 to a lower side against the pressing of the pressing member. As such, the wiper 711 does not hinder capping.

Figure 6B:
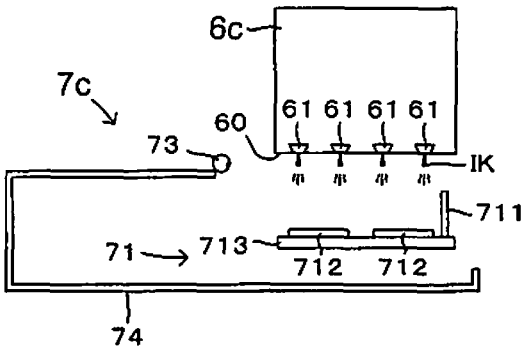

When capping is complete, ink is pressurized using the ink circulation mechanism. When pressurization of the ink is sufficiently performed, capping is released by the head 6*c* being moved to the retreating position. As shown in FIG. 6B, pressurized ink IK is discharged from the nozzle 61 due to the release of capping. At this time, cleaning liquid, foam or the like in the nozzle 61 is discharged from the nozzle 61 to accompany the ink IK which is discharged from the nozzle 61. In this manner, pressurization of the ink stops when the ink is discharged from the nozzle 61 after capping is released.

Wiping is further executed with regard to the nozzle forming surface 60 in pressure cleaning. Here, it is possible to adopt various formats for the wiping, but it is sufficient if, for example, the wiper 711 moves only once from the starting point P1 to the stopping point P2 without cleaning liquid being supplied. Due to this, ink, which is attached to the nozzle forming surface 60 due to being discharged from the nozzle 61, is wiped away. Next, flushing, where ink is discharged from all of the nozzles 61, is executed after the ink circulation speed is reduced to the normal speed and the nozzles 61 are filled with ink in a state where an appropriate meniscus is formed. When the pressure cleaning described above is finished, the state of FIG. 5A is restored by the head 6*c* being moved to the retreating position and the wiper 711 being moved to the standby position.

Here, a method for recovering liquid which drips from the maintenance unit 7*c* during maintenance will be described. In other words, a method for recovering waste liquid (which includes cleaning liquid and ink) which is discharged from the maintenance unit 7*c* will be described.

Figure 7:
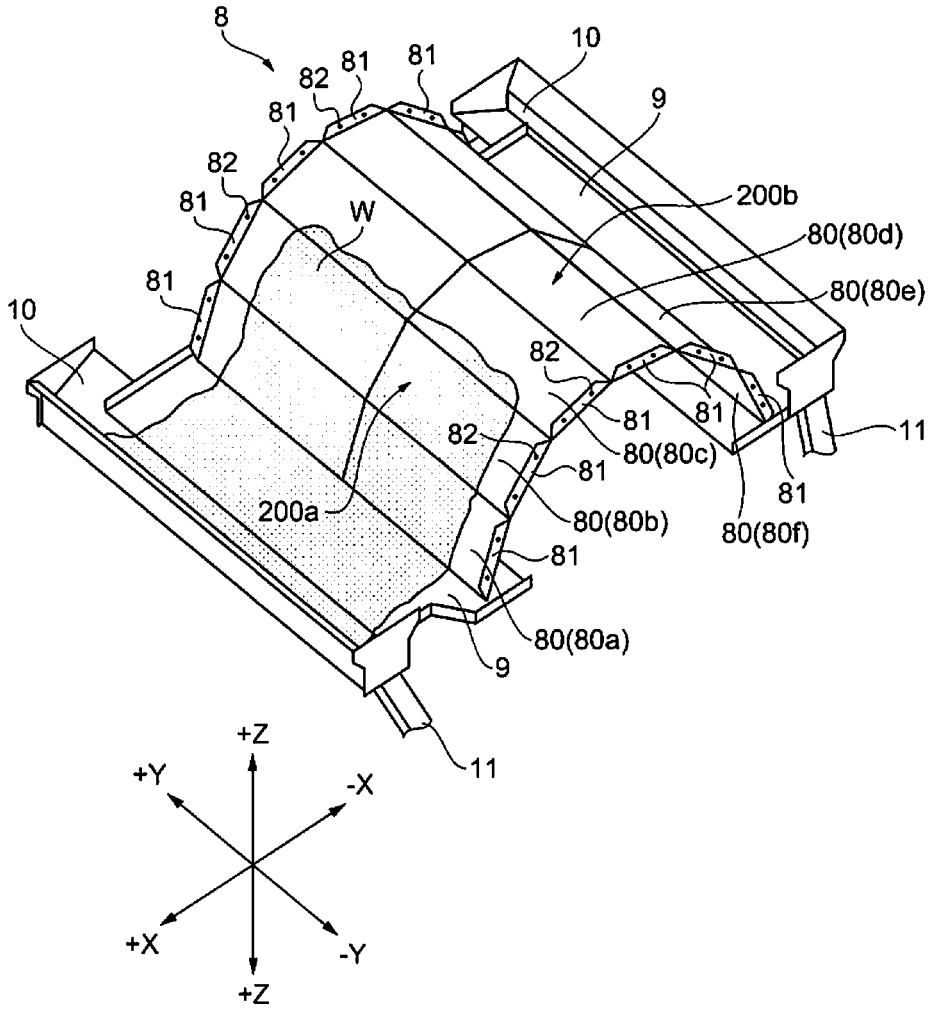
FIG. 7 is a schematic diagram illustrating a method for operating the liquid ejecting apparatus.

Cleaning liquid and ink are discharged due to wiping and pressure cleaning after ejecting of cleaning liquid during maintenance. Waste liquid, which is liquid which is to be discharged, is discharged from the maintenance unit 7 from the discharge opening 74*d* in the maintenance unit 7*c* via the discharge tube 75 (refer to FIG. 4). Then, the receiving section 8 receives waste liquid which drips down from the discharge tube 75. In detail, as shown in FIG. 7, waste liquid W which is discharged from the maintenance unit 7*c* drips down to the inclination 200*a* of the receiving section 8. The waste liquid W drips down to, for example, the member 80*c* which configures the inclination 200*a*. Then, the waste liquid W traverses the inclination 200*a*, in other words, drips down from the member 80*c* to the member 80*b* and then to the member 80*a*. At this time, since a portion of the member 80*c* and the member 80*b* which are adjacent and a portion of the member 80*b* and the member 80*a* which are adjacent overlap, it is possible to prevent leaking of waste liquid between the members 80*a*, 80*b*, and 80*c*. Furthermore, it is possible to prevent leaking of the waste liquid W using the protrusion sections 81 which are provided on each of the members 80*a*, 80*b*, and 80*c*. Then, the waste liquid W which reaches the member 80*a* traverses the relay plate 9 and flows to the gutter section 10. Then, the waste liquid W is recovered at the waste liquid recovery section via the discharge section 11 which is provided in the gutter section 10.

It is possible to obtain the following effects due to the embodiment described above.

The receiving section 8 is arranged below the maintenance units 7 (7*a* to 7*e*) of the maintenance unit group 7U. The receiving section 8 is configured from the plurality of members 80 (80*a* to 80*f*) along an arc shape. Then, since the radius r3 which corresponds to the receiving section 8 has shorter radial dimensions than the radius r2 which corresponds to the maintenance units 7 (7*a* to 7*e*), it is possible for the receiving section 8 to be close with regard to the maintenance units 7 (7*a* to 7*e*). Due to this, waste liquid which drips from the maintenance units 7 (7*a* to 7*e*) is received by the receiving section 8 without splattering and it is possible to efficiently recover waste liquid using the inclinations 200*a* and 200*b*. Furthermore, since the distance between the maintenance units 7 (7*a* to 7*e*) and the receiving section 8 is shortened, it is possible to reduce the size of the configuration of the entirety of the liquid ejecting apparatus 1.

Here, the present invention is not limited to the embodiment described above and it is possible to add various modifications and alterations to the embodiment described above. Modified examples will be described below.

MODIFIED EXAMPLE 1

Figure 8:
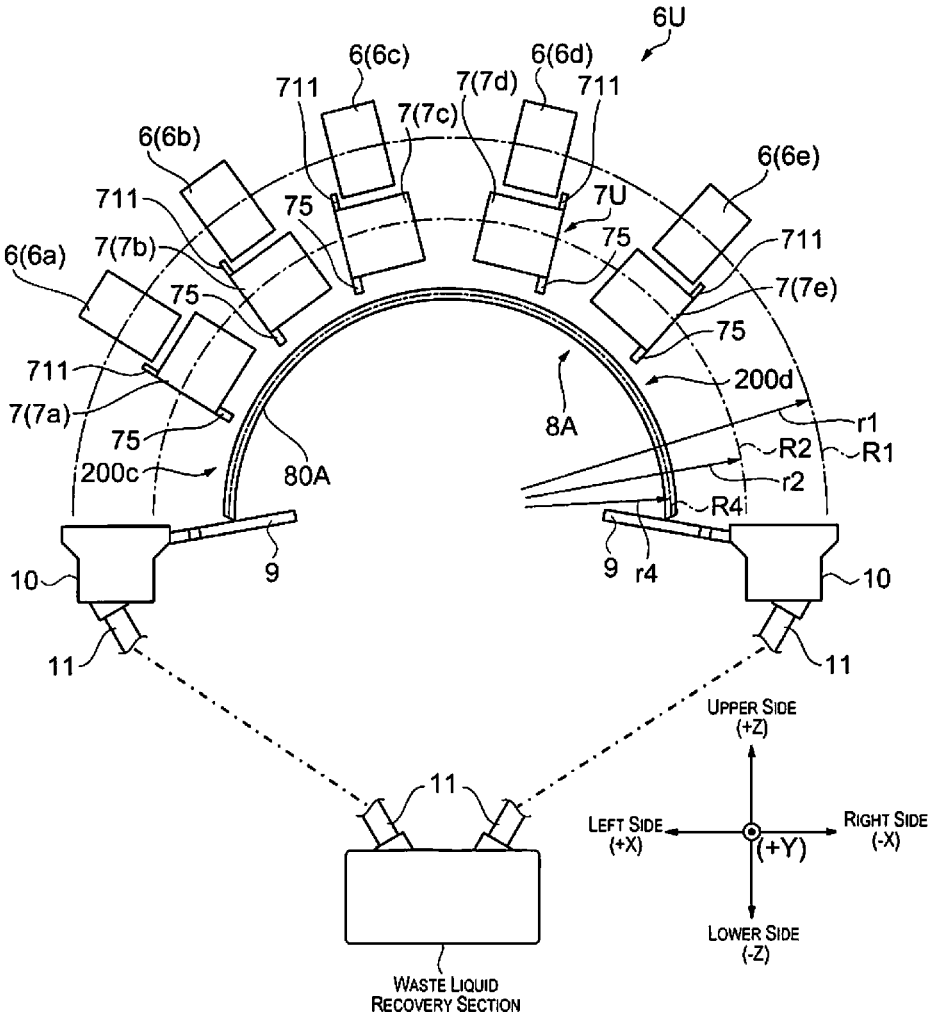
FIG. 8 is a configuration diagram illustrating a portion of a configuration on a liquid ejecting apparatus according to modified example 1.

The receiving section 8 is configured using the plurality of members 80 (80*a* to 80*f*) in the embodiment described above, but the configuration is not limited to this. FIG. 8 is a configuration diagram illustrating a portion of a configuration on a liquid ejecting apparatus according to modified example 1. As shown in FIG. 8, a receiving section 8A may be one member 80A with an arc shape. Here, since the configuration other than the receiving section 8A in FIG. 8 is the same as the configuration of the embodiment described above, the description thereof is omitted. The receiving section 8A has the one member 80A with an arc shape and has countless inclinations. If the inclinations are roughly divided up into two, an inclination 200*c* which faces left and downward and an inclination 200*d* which faces right and downward are provided in the member 80A. Here, the receiving section 8A in modified example 1 is arranged on a virtual line R4 which is an arc. Here, the virtual line R4 which is an arc is a line which is drawn with a radius r4. Then, using the two inclinations 200*c* and 200*d*, it is possible to receive liquid (waste liquid) which is discharged (drips) from the discharge tubes 75 of the maintenance units 7*a* to 7*e*. In addition, the radial dimensions of the radius r1 which represents the arc shape of the heads 6 (6*a* to 6*e*), the radius r2 which represents the arc shape of the maintenance units 7 (7*a* to 7*e*), and the radius r4 which represents the arc shape of the receiving section 8A are different. Then, the radius r4 which corresponds to the receiving section 8A has shorter radial dimensions than the radius r2 which corresponds to the maintenance units 7. As a result, it is possible for the members 80*a* to 80*f* of the receiving section 8A to be close with regard to the respective maintenance units 7*a* to 7*e*. Due to this, it is possible to suppress splatter of the liquid (waste liquid) which is discharged (drips) from the discharge tubes 75 of the maintenance units 7*a* to 7*e*. Furthermore, it is possible to reduce the size of the apparatus configuration.

MODIFIED EXAMPLE2

Figure 9:
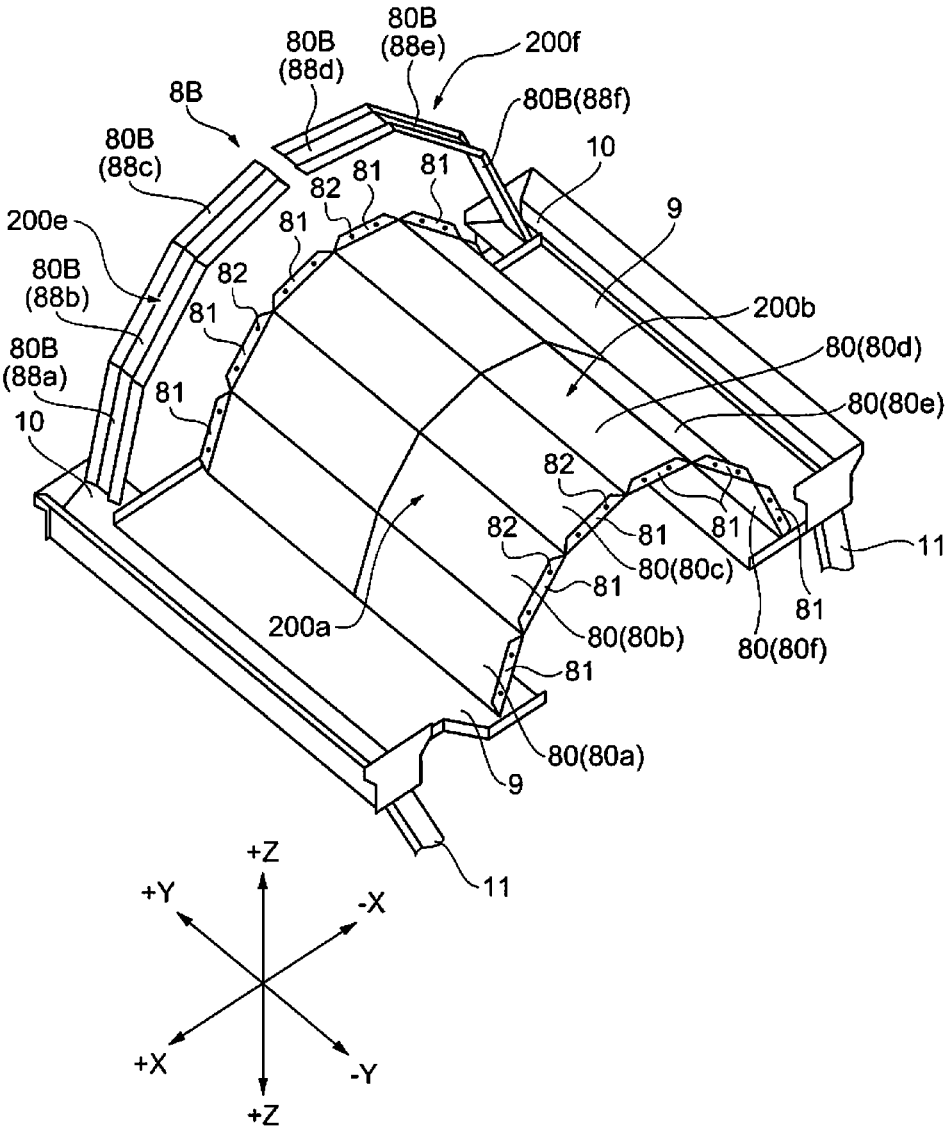
FIG. 9 is a configuration diagram illustrating a portion of a configuration on a liquid ejecting apparatus according to modified example 2.

The receiving section 8 is configured using the plurality of members 80 (80*a* to 80*f*) and has an arc shape with a uniform height in the embodiment described above, but the configuration is not limited to this. FIG. 9 is a configuration diagram illustrating a portion of a configuration on a liquid ejecting apparatus according to modified example 2. As shown in FIG. 9, a receiving section 8B is configured by the members 80 (80*a* to 80*f*) and other members 80B (88*a* to 88*f*). Here, since the configuration of the members 80 (80*a* to 80*f*) is the same as the configuration of the embodiment described above, the description thereof is omitted. The other members 80B are configured by the plurality of members 88*a* to 88*f* and are arranged along an arc shape. The other members 80B (88*a* to 88*f*) have two inclinations 200*e* and 200*f*, the inclination 200*e* is configured using the other members 88*a* to 88*c*, and the inclination 200*f* is configured using the other members 88*d* to 88*f*. Then, the other members 88*a* and 88*f*, which are arranged to be the lowest out of the other members 80B (88*a* to 88*f*), are linked together with the relay plate 9. Here, the other members 80B (88*a* to 88*f*) are joined using fixing members which are not shown in the diagram.

Then, there is a configuration where the heights of the members 80 (80*a* to 80*f*) and the other members 80B (88*a* to 88*f*) are different. In modified example 2, the other members 80B (88*a* to 88*f*) are arranged at high positions which is above the members 80 (80*a* to 80*f*). Due to this, even in a case where, for example, a plurality of the discharge tubes 75, which discharge waste liquid from the maintenance units 7 (7*a* to 7*e*), are provided and the discharge positions of waste liquid differ, it is possible to prevent splatter of waste liquid and the like and reliably recover the waste liquid by the heights of the members 80 (80*a* to 80*f*) of the receiving section 8B corresponding to the heights of the other members 80B (88*a* to 88*f*) of the receiving section 8B and using each of the inclinations 200*a*, 200*b*, 200*e*, and 200*f*.

MODIFIED EXAMPLE3

Figure 10:
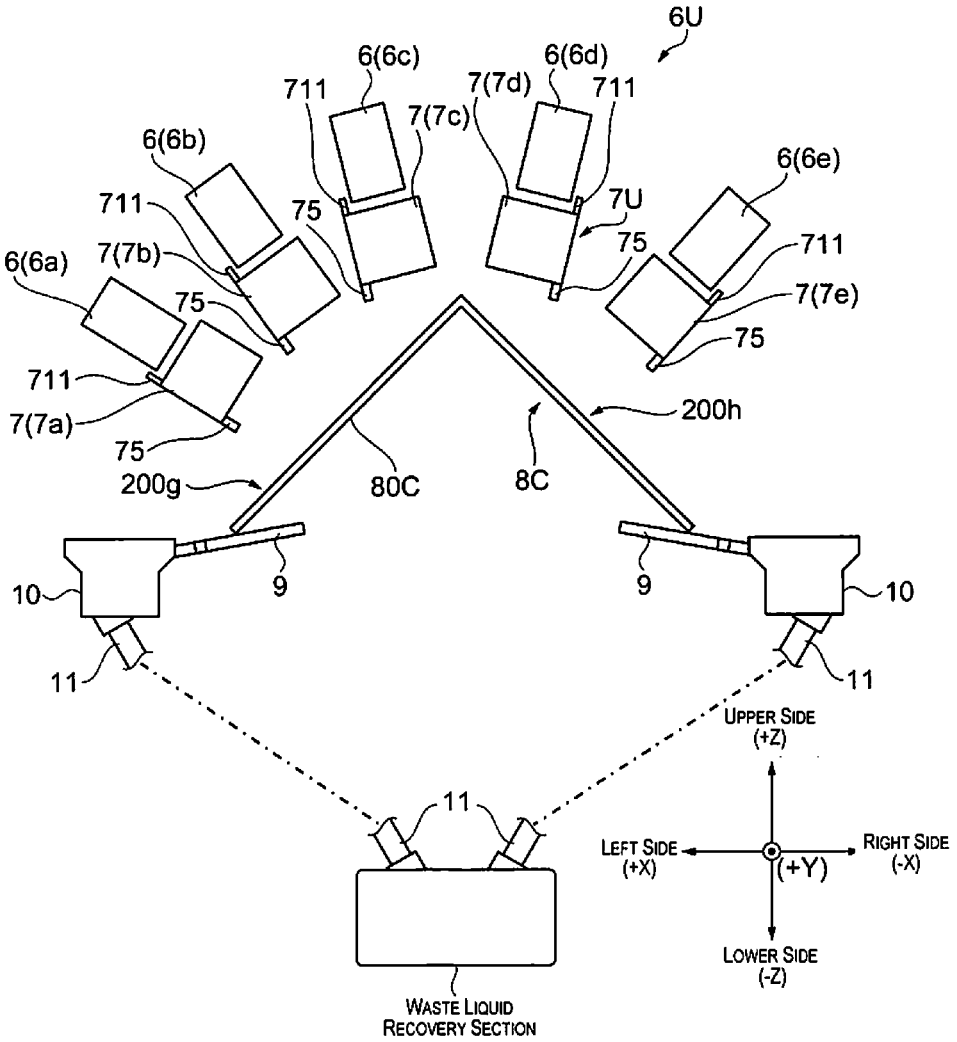
FIG. 10 is a configuration diagram illustrating a portion of a configuration on a liquid ejecting apparatus according to modified example 3.

The receiving section 8 is arranged in an arc shape in the embodiment described above, but the configuration is not limited to this. The receiving section 8 may be configured to be provided with, for example, two inclinations with flat surfaces. FIG. 10 is a configuration diagram illustrating a portion of a configuration of a liquid ejecting apparatus according to modified example 3. As shown in FIG. 10, a receiving section 8C has a member 80C and is provided with two inclinations 200*g* and 200*h*. Then, the two inclinations 200*g* and 200*h* are flat surfaces and are inclined in a straight line in a side surface view. The inclinations need not be two and may be another number such as four or six. In addition, the two inclinations are provided in FIG. 10 by bending the member 80C. In this manner, there may be a plurality of inclinations due to bending. By doing this, it is possible to simplify the configuration of the receiving section 8C and suppress manufacturing costs. Here, since the configuration other than the receiving section 8C in FIG. 10 is the same as the configuration of the embodiment described above, the description thereof is omitted.

MODIFIED EXAMPLE4

The inclinations 200*a* and 200*b* of the receiving section 8 are substantially flat in the embodiment described above, but the present invention is not limited to this. The inclinations 200*a* and 200*b* may be, for example, a waveform shape or a step shape in a cross sectional view. Also by doing this, it is possible to obtain the same effects as described above.

MODIFIED EXAMPLE5

The receiving section 8 is provided with the two inclinations 200*a* and 200*b* in the embodiment described above, but the configuration is not limited to this. For example, three or more inclinations may be provided. By doing this, it is possible to increase the degree of freedom in apparatus layout. Here, six inclinations may be provided with each of the members 80*a* to 80*f* having different inclinations. In addition, eight inclinations may be provided with the relay plate 9 also being inclined. In addition, one inclination may be provided in order to recover liquid without using an absorbing body.

MODIFIED EXAMPLE6

Five of the heads 6 are arranged in the liquid ejecting apparatus 1 in the embodiment described above, but the present invention is not limited to this. For example, there may be four or less of the heads 6, there may be six or more of the heads 6, and it is possible to appropriately change the number of the heads 6. In addition, it is sufficient if the same number of the maintenance units 7 are arranged to match the number of the heads 6. Also by doing this, it is possible to obtain the same effects as described above.

MODIFIED EXAMPLE7

UV ink is described in the embodiment described above as an example of ink which is discharged from the heads 6, but the present invention is not limited to this. For example, it is possible for various inks such as inks with high viscosity to be applied. Also by doing this, it is possible to obtain the same effects as described above.

MODIFIED EXAMPLE8

The members 80*a* to 80*f* have the same shape in the embodiment described above but the members 80*a* to 80*f* may have different shapes.

MODIFIED EXAMPLE9

Each of the maintenance units has the discharge tube 75 in the embodiment described above but this is not necessary. Ink may drip from a hole or an opening in the maintenance units. Here, it is desirable for the distance between the location from which ink drops in each of the maintenance units and the receiving members which receive the ink which drips down to be no more than 100 mm in the vertical direction. If the distance exceeds 100 mm, ink splatters to the outside of the receiving section 8 by going beyond the protrusion sections 81 of the receiving section 8.

MODIFIED EXAMPLE10

An ink jet printer is adopted in the embodiment described above, but a liquid ejecting apparatus which ejects or discharges liquids other than ink may be adopted. It is possible for the present invention to be applied to various types of liquid ejecting apparatuses which are provided with liquid ejecting heads or the like which discharge liquid droplets in minute amounts. Here, the liquid droplets refer to the state of the liquid which is discharged from the liquid ejecting apparatus described above and include liquid droplets which have a granular shape, a tear shape, and a trailing shape. In addition, it is sufficient if the liquid referred to here is a material which is able to be ejected by the liquid ejecting head. For example, it is sufficient if the liquid is in a state where a substance is in a liquid phase, and the substance may be a liquid with high or low viscosity, a body with a fluid form such as a sol, a gel water, another inorganic solvent, an organic solvent, a solution, a liquid resin, or a liquid metal (a metal melt), and includes states other than liquid as one state of matter where particles of a functional material formed of solid matter such as pigments and metal particles are dissolved, dispersed, or mixed into a solvent. In addition, typical examples of the liquids include inks, liquid crystals, and the like as described in the embodiment described above. Here, the inks encompass various types of liquid compositions such as typical water-based inks and oil-based inks, gel inks, hot melt inks, and ultraviolet curable inks. Specific examples of other liquid ejecting apparatuses may include, for example, liquid ejecting apparatuses which eject liquids which include materials in a dispersed or dissolved form such as electrode materials or coloring materials which are used in the manufacturing or the like of liquid crystal displays, electroluminescence (EL) displays, surface-emitting displays, and color filters, liquid ejecting apparatuses which eject bio-organic material which is used in biochip manufacturing, liquid ejecting apparatuses which are used as precision pipettes and which eject liquids which are samples, textile printing apparatuses, micro dispensers, or the like. Furthermore, a liquid ejecting apparatus which ejects a lubricant in a pin point manner in precision machines such as watches or cameras, a liquid ejecting apparatus which forms minute hemispherical lenses (optical lenses) which are used in optical communication elements or the like, a liquid ejecting apparatus which ejects an ultraviolet curable liquid and carries out curing using light or heat, a liquid ejecting apparatus which ejects an etching liquid such as an acid or an alkali in order to etch a substrate or the like, and a liquid ejecting apparatus for textile printing which ejects a liquid onto a cloth or the like may be adopted. Then, it is possible to apply the present invention to any type of liquid ejecting apparatus out of these liquid ejecting apparatuses.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A liquid ejecting apparatus comprising:

a plurality of heads arranged in an arc shape, and configured to eject liquid;

a plurality of maintenance units arranged in an arc shape, and configured to carry out maintenance on the heads;

a receiving section configured to receive liquid that drips from the maintenance units below the maintenance units in a vertical direction, and configured to flow the liquid in at least two directions, the receiving section having an arc shape; and a waste liquid recovery section configured to recover the liquid that has dripped.

2. The liquid ejecting apparatus according to claim 1, wherein when viewed from a direction in which the maintenance units are seen in the arc shape, the receiving section has at least two inclinations, one of the inclinations slopes in a direction from a maintenance unit that is at the highest position out of the maintenance units toward a maintenance unit that is at the lowest position on a left side of a center of the arc shape, and the other of the inclinations slopes in a direction from the maintenance unit that is at the highest position out of the maintenance units toward a maintenance unit that is at the lowest position on a right side of the center of the arc shape.

3. The liquid ejecting apparatus according to claim 1, wherein the receiving section has a plurality of members that are arranged along an arc shape.

4. The liquid ejecting apparatus according to claim 3, wherein portions of the plurality of members overlap when viewed from above in the vertical direction.

5. The liquid ejecting apparatus according to claim 3, wherein the plurality of members have the same shape.

6. The liquid ejecting apparatus according to claim 1, wherein the receiving section has a single member with an arc shape.

* * * * *